US008573705B2

(12) United States Patent
Baird, Jr. et al.

(10) Patent No.: US 8,573,705 B2
(45) Date of Patent: Nov. 5, 2013

(54) MINING APPARATUS WITH PRECISION NAVIGATION SYSTEM

(76) Inventors: John A. Baird, Jr., Flatwoods, KY (US); Ian T. Carr, Ashland, KY (US)

( * ) Notice: Subject to any disclaimer, the term of this patent is extended or adjusted under 35 U.S.C. 154(b) by 1409 days.

(21) Appl. No.: 10/594,787

(22) PCT Filed: Apr. 1, 2004

(86) PCT No.: PCT/US2004/010147
§ 371 (c)(1),
(2), (4) Date: Sep. 29, 2006

(87) PCT Pub. No.: WO2005/104673
PCT Pub. Date: Nov. 10, 2005

(65) Prior Publication Data
US 2007/0216216 A1 Sep. 20, 2007

(51) Int. Cl.
*E21C 35/16* (2006.01)

(52) U.S. Cl.
USPC ..... 299/1.9; 299/66

(58) Field of Classification Search
USPC ..... 299/1.05, 1.4, 1.8, 1.9, 18, 56, 64, 65, 299/67, 66; 280/504; 198/861.1, 861.2, 198/861.4, 861.5, 861.6
See application file for complete search history.

(56) References Cited

U.S. PATENT DOCUMENTS

| | | | | | |
|---|---|---|---|---|---|
| 2,973,949 | A * | 3/1961 | Densmore | 299/64 |
| 3,977,259 | A * | 8/1976 | Goldfein | 74/41 |
| 4,773,520 | A | 9/1988 | Doerr et al. | |
| 4,784,439 | A * | 11/1988 | Wrulich et al. | 299/57 |
| 4,884,847 | A | 12/1989 | Bessinger et al. | |
| 5,795,032 | A * | 8/1998 | Zimmerman | 299/33 |
| 2001/0015573 | A1 * | 8/2001 | Mraz | 299/10 |

FOREIGN PATENT DOCUMENTS

SU 1476141 4/1989

OTHER PUBLICATIONS

International Search Report, Form PCT/ISA/210, 2 pages, for International Application No. PCT/US04/10147 completed on Aug. 21, 2006 and mailed Aug. 24, 2006.

* cited by examiner

*Primary Examiner* — Sunil Singh
(74) *Attorney, Agent, or Firm* — James C. Eaves, Jr.; Brian W. Chellgren; Bingham Greenebaum Doll LLP

(57) ABSTRACT

A mining apparatus includes a miner, a conveyor unit and a steering unit connecting the miner and conveyor unit. The apparatus also includes a heading sensor and a controller responsive to the heading sensor. A first actuator is carried on the miner, the control unit or the steering unit. The first actuator is positioned to a first side of a midline of the miner. Further a second actuator is carried on one of the miner, the conveyor unit and the steering unit. The second actuator is positioned to a second opposite side of the midline of the miner. The first and second actuators are utilized to adjust a connection angle between the miner and the conveyor unit either side of parallel in order to maintain the miner on the desired directional heading.

21 Claims, 11 Drawing Sheets

MINING APPARATUS WITH PRECISION NAVIGATION SYSTEM

TECHNICAL FIELD

The present invention relates generally to the art of mining and, more particularly to a navigation system for a highwall miner and a highwall miner incorporating such a system.

BACKGROUND OF THE INVENTION

Coal, formed from decomposed and compressed vegetable matter, is typically found in substantially horizontal seams extending between sedimentary rock strata such as limestone, sandstone or shale. Surface and underground mining are the primary techniques used to recover this coal.

Surface or strip mining involves the removal of material, known as overburden, overlying a coal seam so as to expose the coal for recovery. In recent years, surface mining has gained prominence over underground mining in the United States. This is due to many factors including:

(a) the increased material moving capacity of surface or strip mining equipment;

(b) lower costs for surface mining than underground mining;

(c) the better safety record of surface mining versus underground mining; and (d) the higher coal recovery percentage for extraction of many coal reserves by surface mining.

Surface mining does, however, have its limitations despite these cited advantages. The primary limiting factor relates to the depth of the overburden. Once the coal seam reaches a certain depth below the surface, the amount of overburden that must be removed to reach the coal simply makes strip mining economically unfeasible.

When this occurs, large quantities of coal may still remain in the ground. If economic recovery of this coal is to be achieved, other mining methods must be utilized. Underground mining application in such an instance is, typically, very limited. This may be due to a number of factors including the existence of poor roof support conditions, the thinness of the seam and/or the presence of insufficient quantities of coal to warrant the large capital investments characteristic of underground operations.

Due to these considerations, auger mining has often been used to recover coal following a strip mining operation where the overburden becomes too costly to remove. A large auger is used to bore into the face of the seam and recover the coal from beneath the overburden. Advantageously, auger mining is very efficient providing more tons per man per day than any other form of state of the art mining techniques. Auger mining may also be initiated quickly and requires a relatively low capital expenditure when compared to surface and underground mining. Auger mining has also been found to date to be the best method to use in relatively thin seams. Further, auger mining is safer than both surface and underground mining. Thus, auger mining may be used to effectively supplement a strip mining operation and recover small coal deposits that would otherwise be left behind.

Auger mining is, however, also not without its disadvantages. Auger mining provides a relatively low total coal recovery. Coal recovery for the resource area being augured is usually less than about 35%. Some of the lost recovery is due to the pillars of coal that are left standing to support the overburden between adjacent auger holes. The majority of the recovery shortfall, however, is due to the limited penetration depths achievable with even state of the art auger mining equipment.

More particularly, as penetration depths increase, a greater number of auger flights are required to convey the coal from the cutting head to the seam face for recovery. Each flight adds to the frictional resistance to the turning of the auger through contact with the walls of the bore hole. Additionally, the longer the string of auger flights, the greater the weight of coal being moved by the flights at any one time. As a result, it should be appreciated that auger power requirements increase rapidly with the depth of auger penetration.

Due to the above considerations, holes drilled by conventional auguring equipment are usually only of a depth of 150 feet with 200 feet being rarely attainable. Of course, any increase in this figure is desirable as it would greatly improve the coal recovery rate from a resource area.

A mining system and method has been developed to meet this end. More particularly, this highwall system and method is disclosed in a series of U.S. Patents owned by the assignee of the present invention. The patents are U.S. Pat. Nos. 5,522,647; 5,364,171; 5,261,729 and 5,232,269. The full disclosure made in these patents is incorporated herein by reference.

As best shown in FIG. 1, the mining system includes a continuous miner for cutting coal from a coal seam. The cut coal is fed by the miner to a conveyor train comprised of a series of modular conveyor units serially connected end-to-end. This system allows mining to depths far exceeding the 150 to 200 feet possible with conventional auger mining equipment. In fact, depths of up to approximately 2000 feet have been reached.

Each conveyor unit is supported on ground engaging wheels so as to be adapted to follow the miner as the miner advances into the coal seam. A launch vehicle is also incorporated into this new system. The launch vehicle includes a conveyor mechanism for receiving and conveying aggregate coal discharged by the conveyor train. The launch vehicle also includes a guide track for supporting the end unit of the conveyor train and a conveyor unit to be added to the train. Further, individual drive assemblies are provided for (1) advancing/withdrawing the conveyor train with the miner and for (2) pushing the new conveyor unit into engagement with the conveyor train. Advantageously, the system allows the aggregate coal to be cut and conveyed without interruption even when a conveyor unit is being added to the train. Hence, the system not only provides significantly improved recovery from the resource area but also operates more efficiently than augering equipment and provides improved productivity.

The present invention relates to a navigation system for the miner that allows for precision guidance so that a proper pillar is maintained between mined openings and no break-through to a previously mined opening occurs even when mining to extreme depths from the coal face. Further, the navigation system enables the miner to better follow the coal seam and therefore mine with greater efficiency.

SUMMARY OF THE INVENTION

In accordance with the purposes of the present invention as described herein, an improved mining apparatus is provided. The mining apparatus includes a miner, a conveyor unit and a steering unit connecting the miner to the conveyor unit. Additionally, the apparatus includes a positioning sensor, a controller responsive to the positioning sensor and first and second actuators.

The first and second actuators are carried on either the miner, the conveyor unit or the steering unit. The first actuator is positioned to a first side of the midline of the miner. The second actuator is positioned to a second, opposite side of the midline of the miner. The first and second actuators adjust a connection angle between the miner and the conveyor unit either side of parallel in order to determine a directional heading for the miner.

More specifically describing the invention, the first actuator includes a first displaceable guide element. Similarly, the second actuator includes a second displaceable guide element. The first displaceable guide element has a first end having a first convex crown while the second displaceable guide element has a second end having a second convex crown. Both the first and second convex crowns have a radius of curvature of about sixteen inches.

In one possible embodiment the first actuator is a first hydraulic cylinder and the second actuator is a second hydraulic cylinder. Each of the cylinders may have a bore of about 10 inches, a stroke of about 1.5 inches and run at up to about 3,500 psi to produce up to 137 tons of force.

In one embodiment of the invention the first and second actuators are carried on the steering unit. In this embodiment the first and second crowns/ends respectively engage first and second cooperating bearing surfaces on the miner. By extending one actuator and retracting the other, the connection angle between the miner and the conveyor unit is adjusted to bring the miner to a desired course heading.

In a second embodiment the first and second actuators are again carried on the steering unit. The first and second crowns/ends, however, respectively engage first and second cooperating bearing surfaces on the conveyor unit. Once again, steering of the miner to a desired heading is accomplished by extending and retracting the actuators as necessary.

In yet another embodiment of the invention the first and second actuators are carried on the miner. The first and second ends of the actuator respectively engage the first and second cooperating bearing surfaces on the steering unit. Again, relative extension and retraction of the actuators functions to provide steering of the miner.

In yet another possible alternative embodiment the first and second actuators are carried on the conveyor unit. In this embodiment the first and second ends respectively engage the first and second cooperating bearing surfaces on the steering unit. Once again, relative extension and retraction of the actuators functions to adjust the connection angle between the miner and the conveyor unit thereby bringing the miner to a desired directional heading.

Still further describing the invention, the steering unit is connected by a first pivot pin to the miner and a second pivot pin to the conveyor unit. The first pin extends along a first plane while the second pin extends along a second plane. The two planes may be substantially perpendicular to one another.

In one arrangement the first plane is horizontal while the second plane is vertical. In another arrangement the first plane is vertical while the second plane is horizontal. Advantageously, the horizontal/vertical and vertical/horizontal pin arrangements function to provide enough play or clearance to allow the miner and conveyor unit to follow the seam as it moves up and down in the strata including any possible undulations that may be traversed. Further, the side-to-side clearance allows heading correction so that an appropriate pillar may be maintained between mining holes or openings including those extending deep behind the exposed face of the seam.

In accordance with yet another aspect of the present invention the apparatus may include a mineral seam sensor. The mineral seam sensor, such as a gamma sensor is provided to locate the top and bottom of the mineral seam being mined. Operation of the cutter drum may then be controlled to insure that the mineral being mined is won without cutting through the seam into the underlying or overlying strata. Further it allows the operator to maintain a desired roof configuration.

In accordance with yet another aspect of the present invention, a guidance control apparatus is provided for a mining apparatus including a miner and a conveyor unit. The guidance control apparatus may be described as including a positioning sensor, a controller responsive to the positioning sensor and at least one actuator responsive to the controller for adjusting a directional heading of the miner.

Alternatively, the guidance control apparatus may be described as including a positioning sensor, a controller responsive to the positioning sensor and a steering unit connected to both the miner and the conveyor unit. Additionally the apparatus includes a first actuator carried by one of the miner, conveyor unit and steering unit. The first actuator is responsive to the controller to adjust a connection angle between the miner and the conveyor unit for adjusting a directional heading of the miner.

In accordance with yet another aspect of the present invention a method is provided of guiding a mining apparatus including a miner and at least one conveyor unit through a mineral seam. The method includes the steps of positioning a guide mechanism between the miner and the at least one conveyor unit, exerting a force between the miner and the at least one conveyor unit whereby a connection angle between the miner and the conveyor unit is changed and advancing the mining apparatus after adjusting the connection angle.

Alternatively, the method may be defined as comprising the steps of determining an actual position for the miner, comparing the actual position to a desired position and directional heading for the miner, adjusting a steering mechanism engaged between the miner and the conveyor unit to bring the miner to the desired directional heading and advancing the miner along the desired directional heading.

By yet another alternative definition, the method may be described as comprising the step of adjusting a heading for movement of the miner by controlling a connection angle between the miner and the conveyor unit.

In the following description there is shown and described several embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and together with the description serve to explain certain principles of the invention. In the drawings.

Figure 1:
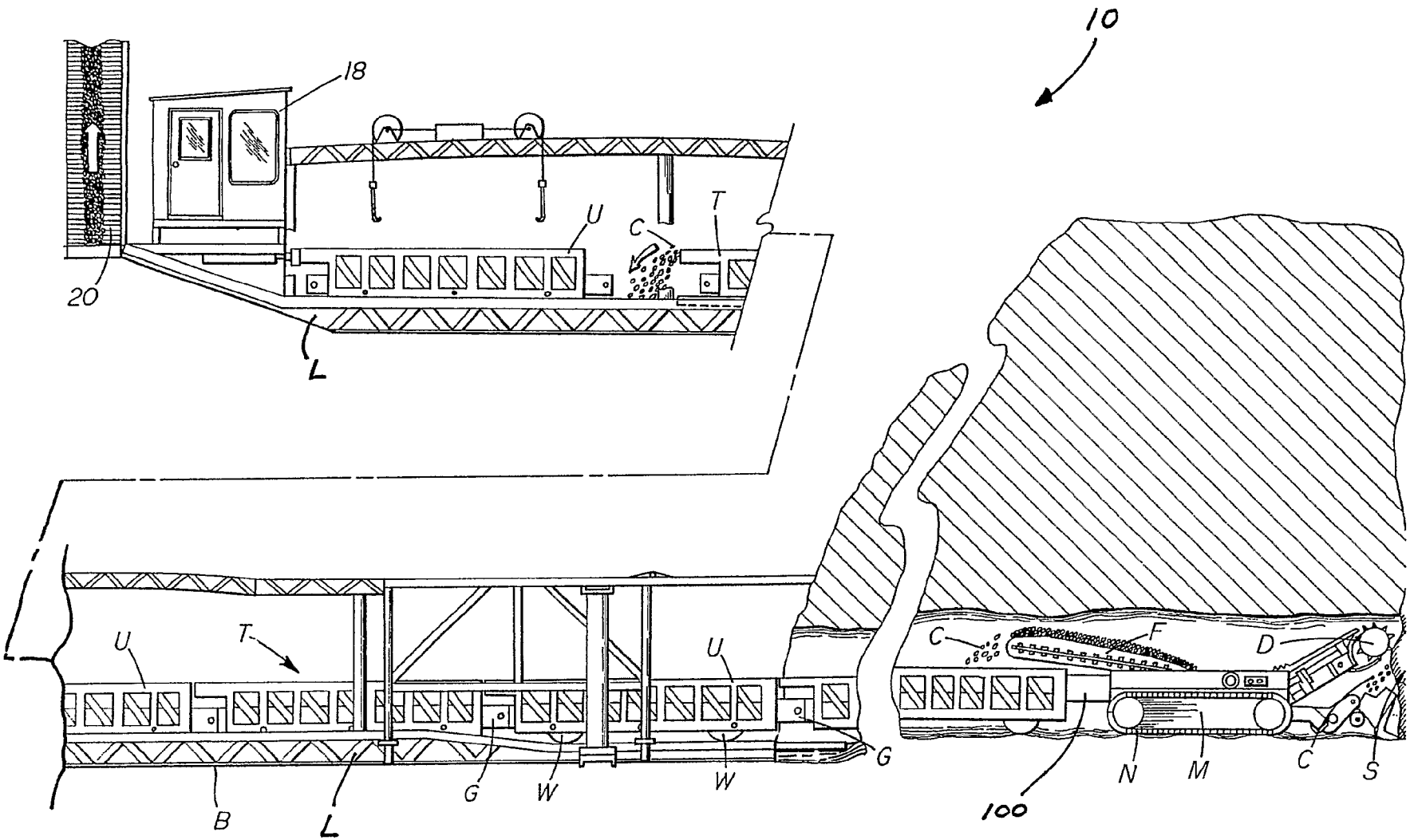
FIG. 1 is a schematical view showing the mining apparatus of the present invention including a launch vehicle, a miner, multiple, modular conveyor units that form a conveyor train behind the miner and a guide mechanism for controlling the heading of the miner as it is advanced into the mineral seam.

Reference will now be made in detail to the embodiments of the present invention illustrated in the drawing figures.

DETAILED DESCRIPTION OF THE INVENTION

Reference is now made to FIGS. 1, 2, 3*a* and 3*b* schematically showing the mining apparatus 10 of the present invention. The mining apparatus 10 includes a launch vehicle L adapted for utilization with a continuous mining system including a continuous mining machine M of a type known in the art. The mining machine M includes a rotating cutter head drum D supporting a series of cutting bits on helical flights (not shown). The cutter head drum D is rotatably mounted on a vertically moveable boom that is pivotally mounted on the main frame member of the mining machine M. As also shown, the mining machine is supported for movement along the floor of the mine by a pair of crawler assemblies N.

In operation, the mining machine M is preferably advanced into the seam face S with the boom raised and the cutter head drum D rotating. As the cutting begins at the top level or roof line of the seam, the mining machine M is advanced further forward and the boom is gradually lowered. As the mining machine M is advanced and the boom is raised and lowered, coal C is cut from the seam face S. The aggregate coal C is then collected by means of a conventional gathering head that serves to deliver the aggregate coal to a flight conveyor F.

As shown in FIG. 1, the flight conveyor F delivers the aggregate coal C to the lead conveyor unit U of a conveyor train generally designated by reference letter T. The conveyor train T also includes a series of modular conveyor units U identical to one another that are releasably coupled together in series behind the lead conveyor unit.

As best described in issued U.S. Pat. No. 5,112,111 entitled APPARATUS AND METHOD FOR CONTINUOUS MINING and assigned to the Assignee of the present invention, each of the conveyor units U includes a main structural frame supported for movement on the ground by a series of wheels W. Each conveyor unit U also includes a centrally disposed, longitudinally extending inclined conveyor. The conveyor, which is preferably of the belt type, operates to convey aggregate coal C received at the low end to the high end where it is discharged from one conveyor unit U to the next conveyor unit in the series. Each conveyor unit U also includes its own motor for driving the belt conveyor held therein. The units U of the conveyor train T are also interconnected by means of control lines that are first routed from a power source such as a generator (not shown) on the bench to the mining machine M and back through the individual conveyor units U. Accordingly, the motors of the conveyor units are connected in series for simultaneous operation at a substantially consistent speed.

Each of the conveyor units U also includes a coupling mechanism G specifically adapted to allow the units to be coupled together in a rigid manner so that the units of the train T remain in completely straight alignment behind the mining machine M. Such a coupling mechanism may, for example, include cooperating devises on each conveyor unit that are received together in an interdigitating manner and connected by means of a pin.

As should be appreciated from viewing FIG. 1, the conveyor train T includes as many conveyor units U as are necessary to have the train extend out of the seam to the launch vehicle L on the bench B. As shown, preferably the bench B is undercut below the bottom of the seam so as to receive the launch vehicle or platform L.

Figure 2:
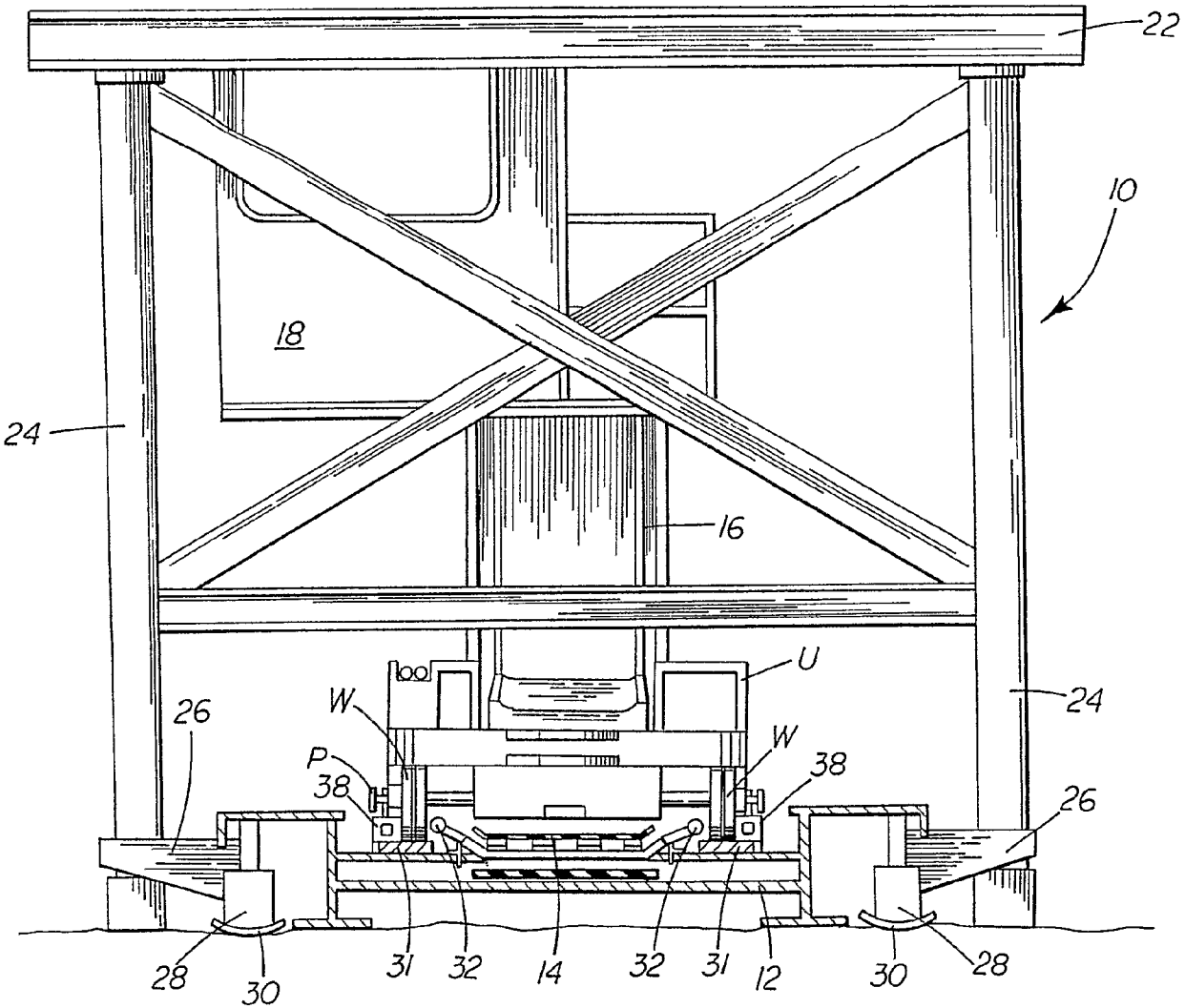
FIG. 2 is a partially sectional schematic view showing a modular conveyor unit resting on the frame of the launch vehicle.
Figure 3B:
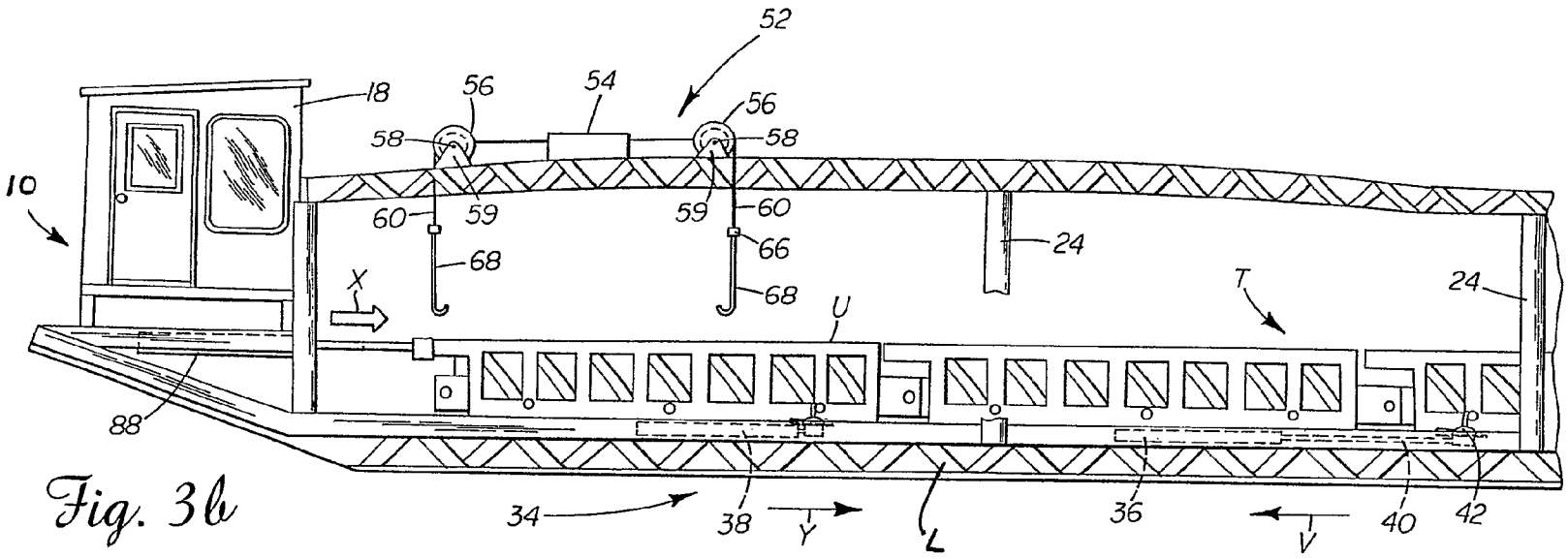
FIGS. 3*a* and 3*b* are schematical side elevational views illustrating the advancing of the conveyor train by the shuttling action of the pair of cooperating tandem drive cylinder sets as well as the addition of a modular conveyor unit to the train.
Figure 3A:
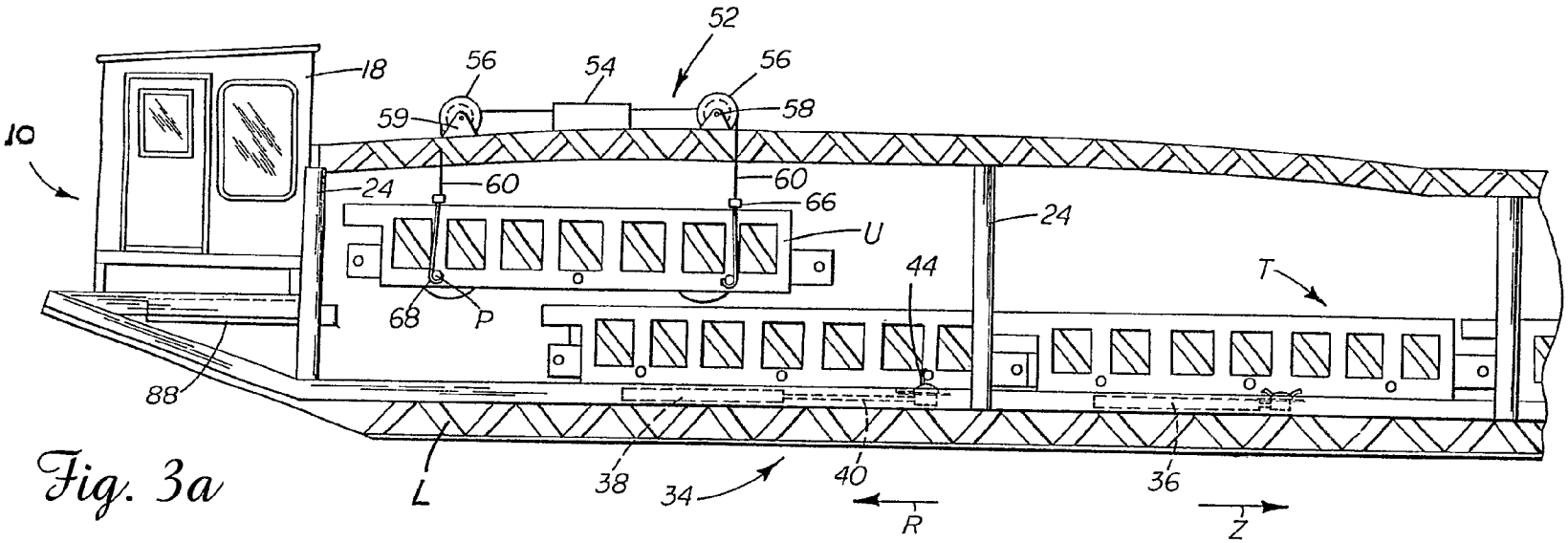
Figure 4:
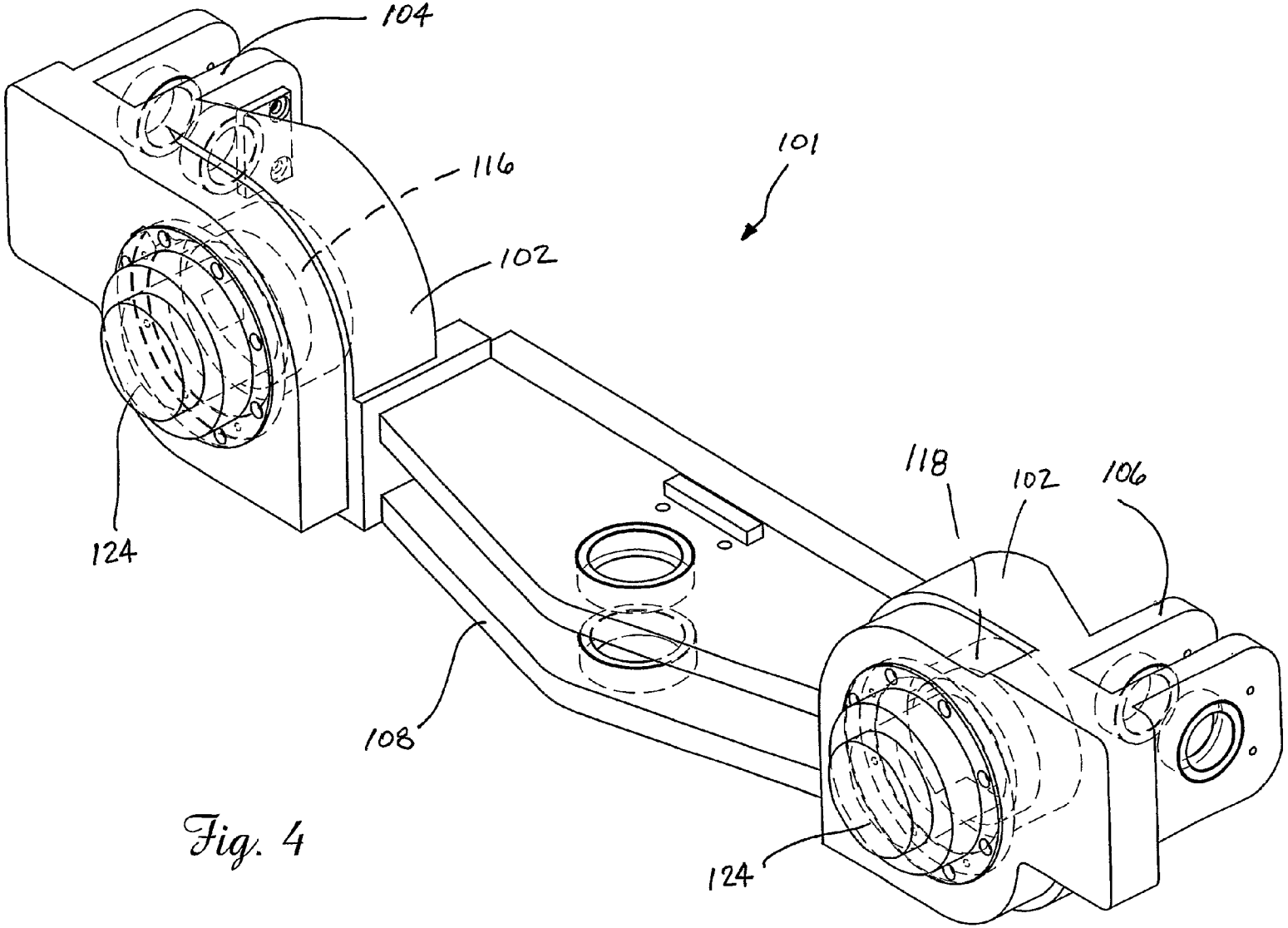
FIG. 4 is a perspective view of the steering unit.

As best shown in FIGS. 2, 3*a* and 3*b*, the launch vehicle L includes a main structural framework 12 that supports an aggregate material conveyor 14, preferably of the belt type. This conveyor 14 receives the aggregate coal C from the last conveyor unit U of the train T. The coal C is then delivered by the aggregate material conveyor 14 up an incline 16, beneath the operator control cab 18, to a discharge conveyor 20. The discharge conveyor 20 is also inclined and may, for example, be utilized to convey the aggregate coal C to a delivery location such as the bed of a truck which is used to haul the coal away for stockpiling or further processing.

As also shown in FIGS. 2, 3*a*, and 3*b*, the launch vehicle L includes a safety canopy 22. The safety canopy 22 is connected to the main structural framework 12 by a series of spaced support posts 24 and braces 26. Two series of jacks 28 are provided spaced along the length of the launch vehicle L. The jacks 28 are supported on skids 30 and may be actuated to lift the main framework 12 of the launch vehicle L from the bench B so as to allow movement of the launch vehicle by heavy equipment or by auger skids to a mining location.

As also shown in FIG. 2, the launch vehicle L includes a pair of spaced guide tracks 31 in the form of spaced floor grate sections that are adapted to support the ground engaging wheels W of the modular conveyor units U. Additionally, a pair of guide rails 32 are provided adjacent and outside the sides of the aggregate conveyor 14. These guide rails 32 extend upwardly above the floor grate sections 31 and outwardly from the aggregate material conveyor 14 toward the inner surfaces of the ground engaging wheels W of the conveyor units U. In the event a conveyor unit U is positioned on the launch vehicle L slightly out of alignment with the aggregate material conveyor 14, the inner surfaces of the wheels will engage the rails 32 thereby realigning the modular conveyor unit U with the conveyor train T as necessary to insure proper alignment. Advantageously, by maintaining proper alignment of the end unit of the conveyor train T so that it overlies the launch vehicle conveyor 14, aggregate material from the conveyor train is received and conveyed by the launch vehicle conveyor at all times of operation.

As best shown in FIGS. 3*a* and 3*b*, the launch vehicle L also includes a drive assembly, generally designated by reference numeral 34. The drive assembly 34 is specifically adapted for selectively aiding in the advancement or withdrawal of the conveyor train T. More specifically, the drive assembly 34 includes a pair of cooperating tandem drive cylinder sets 36, 38. Only one drive cylinder of each set 36, 38 is shown in FIGS. 3*a* and 3*b* as the tandem cylinders of each set are mounted to the main framework 12 on opposing sides of the launch vehicle conveyor 14 (see also FIG. 2*a*). As shown, the forward tandem drive cylinder set 36 is mounted longitudinally aligned with and spaced from the rearward drive cylinder set 38. Further, as also made clear from viewing FIG. 2*a*, each tandem cylinder set 36, 38 has a left side and right side cylinder. Both of the tandem cylinders of the forward set 36 operate together. Similarly, both of the tandem cylinders of the rearward set 38 operate together.

Each drive cylinder of sets 36, 38 includes an extensible cylinder rod 40. A pusher arm unit is mounted to a distal end of each cylinder rod 40. Each pusher arm unit includes a substantially V-shaped pusher arm 44 pivotally mounted to a base by means of a pivot pin. As described in issued U.S. Pat. No. 5,232,269 entitled Launch Vehicle for Continuous Coal Mining", the pusher arm 44 may be selectively positioned in a first position for engaging a cooperating pin P on a conveyor unit U and advancing the conveyor train T into the coal seam S. Alternatively, the pusher arm 44 may be selectively positioned in a second, opposite position for also engaging a cooperating pin P and withdrawing the conveyor train T from the coal seam S.

Advantageously, the drive assembly 34 is sufficiently powerful to aid in advancing (withdrawing) the conveyor train T and mining machine M into (from) the seam face F. This is a particularly important advantage as in many mining areas soft bottom conditions, such as fire clay, exist. The crawler assemblies N on a conventional mining machine M tend to dig ruts in the soft bottom until the main frame of the mining machine "high centers" and comes to rest on the undisturbed bottom material between the ruts. Accordingly, continuous mining machines M have a propensity to become stuck where soft bottom conditions are present. As such, mining of these types of seams was often avoided in the past. In contrast, with the present system, mining of these seams is now possible. Thus, the present apparatus effectively opens new areas for mining thereby increasing recoverable coal reserves.

The launch vehicle L of the present invention also includes a mechanism for adding individual modular conveyor units U to the conveyor train T as it is advanced into the coal seam. The mechanism for adding a modular conveyor unit is generally designated by reference numeral 52 and best shown in FIGS. 3*a* and 3*b*. The conveyor unit adding mechanism 52 includes a power source or drive motor 54 connected via a power output transmission (not shown) to a pair of take-up reels 56. Each take-up reel 56 is rotatably mounted upon a shaft 58 held in a cradle 59 mounted to the overlying canopy 22. One take-up reel 56 is mounted adjacent the operator cab 18. The other take-up reel 56 is mounted forward of the first one approximately the length of a conveyor unit (e.g. 45 feet).

A line or heavy duty cable 60 is mounted to each take-up reel 56. More particularly, the proximal end of each line 60 is attached to the associated take-up reel 56 so that rotation of the reel pays out or takes-up the line. The distal end of each line 60 is attached by means of a yoke 62 to a sling 64 that holds a cross bar 66. A pair of downwardly extending hooks 68 are attached to the cross bar 66 at each end. The hooks 68 are adapted to engage the pins P at the ends of a conveyor unit U to be suspended by the winch lines 60. Of course, any other appropriate arrangement could be utilized that is adapted for connecting the winch lines 60 to a conveyor unit U.

Advantageously, the ability to add an indefinite number of modular conveyor units U to the conveyor train T functions in conjunction with the crawler assemblies N of the miner M and the drive cylinder sets 36, 38 on the launch vehicle L to provide the necessary requirements to allow mining deep behind the exposed face of the seam. In fact, depths of 1600 to 2000 ft. or more can be achieved. However, the miner should be guided precisely as it is advanced into the seam to insure the most efficient and effective mining. This is because a column, wall or pillar of coal must be maintained between each mine opening in order to support the overburden and prevent undesirable subsidence following the mining operation. Further, in the event a miner M breaks through a pillar into an adjacent mined opening, a roof fall may occur. This can result in the miner M and perhaps several of the conveyor units U becoming trapped underground deep in the coal seam. A miner M is a substantial capital investment and the loss of a miner must be avoided if at all possible. Further, even if a successful recovery operation can be completed, it should be appreciated that coal production is shut down for the recovery period at a substantial cost to the operator. Thus, it should be appreciated that efficient and effective deep highwall mining depends upon the ability to pinpoint the location of the miner M and precisely guide the miner on a directional heading as necessary to maintain proper pillar dimension and prevent breakthroughs into adjacent mining holes.

The guidance control apparatus 100 for providing the necessary precision to guide the miner M to maintain a proper pillar between nine openings during deep mining will now be described. Specifically, a steering unit, generally designated by reference numeral 101, is schematically illustrated in FIG. 1. As shown the steering unit 101 is connected between the miner M and the first conveyor unit U behind the miner. As best illustrated in FIGS. 5*a*-5*d* and 6, the steering unit 101 includes a frame 102. A first clevis 104 is provided on the frame 102 adjacent a first lateral end of the frame. Similarly, a second clevis 106 is provided on the frame 102 adjacent a second, opposite lateral end thereof. A third clevis 108 is provided along an intermediate section of the frame 102 between the first and second devises 104, 106. As should further be appreciated, the two outer devises 104, 106 are provided on a first face of the frame 102 and face in a first direction while the third clevis 108 is provided on the opposite face of the frame and faces a second, opposite direction. As should further be appreciated, the first and second devises 104, 106 at the ends of the frame 102 include a pair of cooperating plates extending in a vertical direction. The third clevis 108 provided at the intermediate portion of the frame includes a pair of cooperating plates extending in a substantially horizontal direction.

Each clevis 104, 106, 108 defines a channel for receiving a mounting lug or bracket 110, 112, 114 respectively. As will be described in greater detail below each mounting lug or bracket 110, 112, 114 is provided on either the miner M or the conveyor unit U. A first pivot pin is secured in aligned cooperating apertures of the first clevis 104 and the mounting bracket 110 in order to secure the mounting bracket in the clevis. Another first pivot pin 116 is secured in cooperating apertures in the second clevis 106 and the mounting bracket 112 in order to secure that mounting bracket in the clevis. A second pivot pin 118 is secured in aligned cooperating apertures in the third clevis 108 and mounting bracket 114 in order to secure that mounting bracket in the third clevis.

Figure 7B:
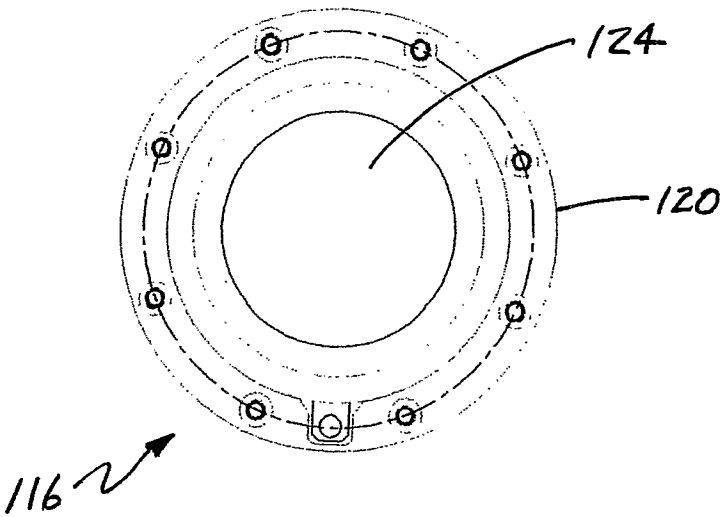
FIG. 7*b* is a front elevational view of the actuator illustrated in FIG. 7*a*.
Figure 7A:
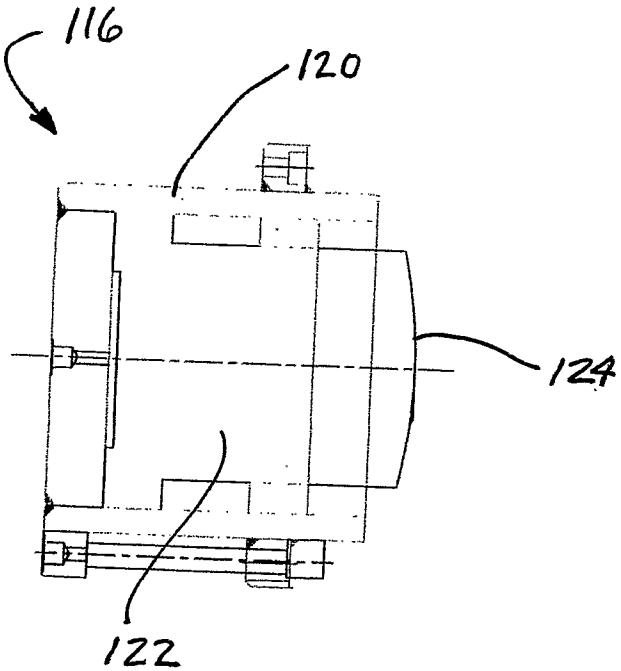
FIG. 7*a* is a schematical representation of one of the actuators of the present invention.
Figure 8:
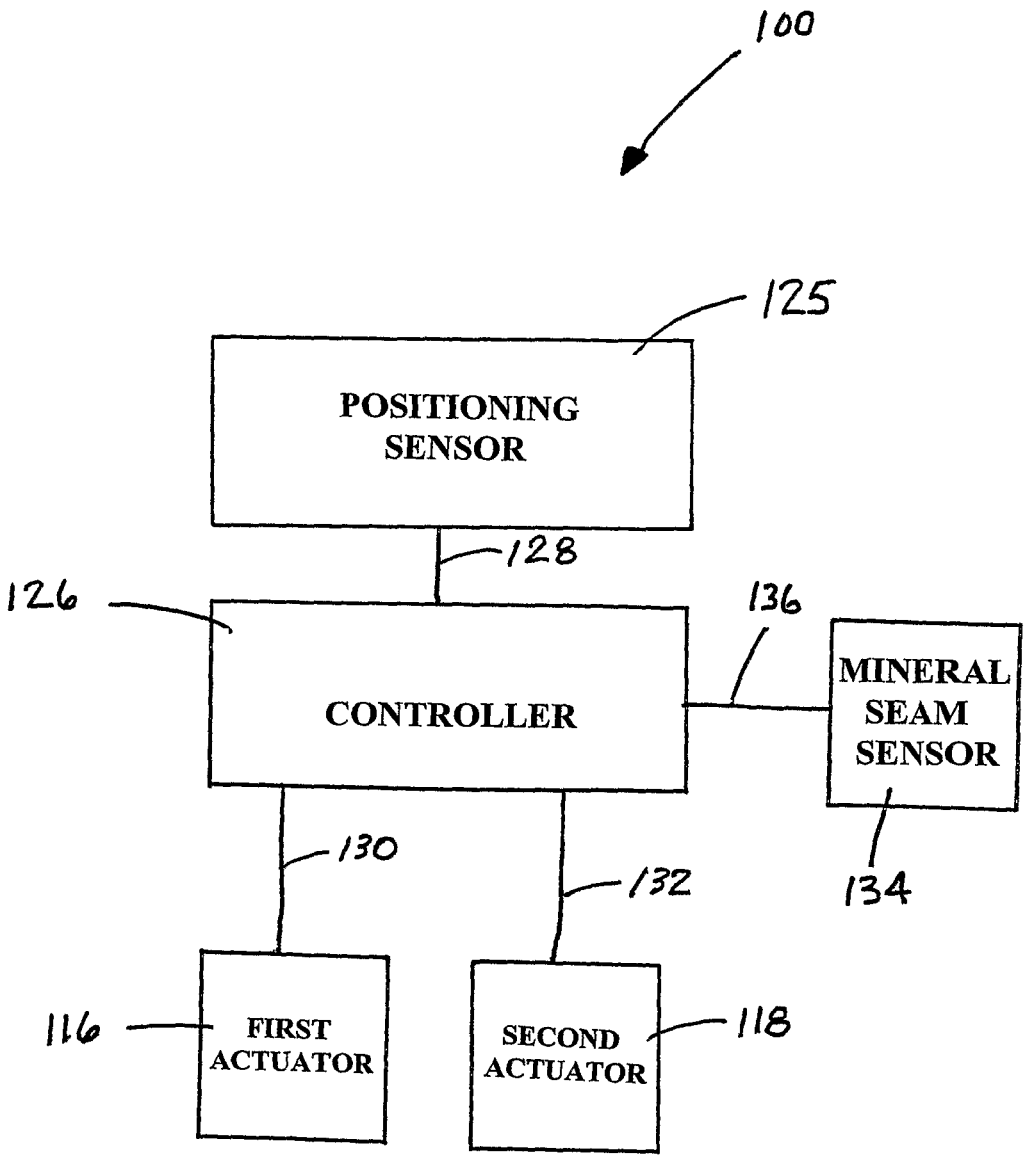
FIG. 8 is a schematical block diagram of the guidance control system for the present invention.

As further illustrated with reference to FIG. 8, the guidance control apparatus 100 also includes a first actuator 116 and a second actuator 118. As illustrated in FIGS. 7*a* and 7*b* the first actuator 116 may comprise a hydraulic cylinder 120 and cooperating piston/displaceable guide element 122. The first end of the displaceable guide element 122 has a first convex crown 124. In the illustrated embodiment the convex crown 124 has a sixteen inch radius of curvature. While not illustrated, the second actuator 118 may comprise a second hydraulic cylinder, second piston/displaceable guide element and second crown identical to that illustrated in FIGS. 7*a* and 7*b* and described above with reference to the first actuator 116.

The guidance control apparatus 100 also includes a positioning sensor 125, a controller 126 and a mineral seam sensor 134. The controller 126 is connected to the positioning sensor 125 by the control line 128. The controller 126 is connected to the first and second actuators 116, 118 by respective control lines 130, 132. Additionally, the controller 126 is connected by the control line 136 to the mineral seam sensor 134.

The positioning sensor 125 is a precision inertial positioning and pointing system that has been specially adapted for use on mining equipment. Such a positioning sensor 125 is manufactured and marketed by Honeywell, Inc. under the Horta® trademark (Honeywell Ore Recovery/Tunneling Aid). The Horta® device is a completely autonomous self-contained dynamic reference unit inertial navigator mechanized using strap down inertial algorithms, three-ring laser gyroscopes for angular motion sensing, three Q-flex accelerometers for translation measurements and special software for mining applications.

The mineral seam sensor 134 is particularly adapted to locate the top and bottom of the mineral seam. A mineral seam sensor 134 particularly useful for the intended purpose is a gamma sensor such as the AME Model 1008 Coal Thickness Sensor manufactured and marketed by American Mining Electronics, Inc.

FIGS. 5*a*-5*d* illustrate four different embodiments of the present invention. In all of these embodiments, the steering unit 101 is connected between the miner M and the adjacent conveyor unit U. In the embodiment illustrated in FIG. 5*a*, the first and second devises 104, 106 receive the mounting brackets 110, 112 connected to the frame or bumper 150 of the miner M. Two first pivot pins 113 complete each of these connections. As should be appreciated, each pivot pin 113 extends in a substantially horizontal plane.

The third clevis 108 receives the third mounting bracket 114 mounted to the frame or bumper 152 of the conveyor unit U. The second pivot pin 115 completes the connection of the third clevis 108 and third mounting bracket 114. As should be appreciated, the second pivot pin 115 extends in a plane substantially perpendicular to the plane in which the first pivot pins 113 extend. Thus, in this embodiment the first pivot pins 113 extend in a substantially horizontal plane while the second pivot pin 115 extends in a substantially vertical plane.

The first actuator 116 and second actuator 118 are mounted to the frame 102 of the steering unit 101. More specifically, as illustrated the first actuator 116 is mounted to the frame 102 between the first clevis 104 and the third clevis 108. Similarly, the second actuator 118 is mounted to the frame 102 between the second clevis 106 and the third clevis 108. Thus, it should be appreciated that the two actuators 116, 118 are mounted to the frame 102 of the steering unit 100 so that they are laterally spaced with one on each side of a line extending from the midline 154 of the miner M.

During operation, the guidance control apparatus 100 functions to adjust the connection angle between the miner M and the conveyor unit U in order to determine and adjust the directional heading of the miner M as it advances through the mineral seam. More specifically, the displaceable guide elements 122 of each actuator 116, 118 are extended with the crown 124 of each guide element engaging a cooperating bearing surface 156 on the bumper 152 of the conveyor unit U. When the displaceable guide elements 122 are extended one half the length of their stroke (e.g. three-quarter inch extension for a cylinder with a total stroke of 1.5 inches), the miner M is positively held by the actuators 116, 118 so as to be aligned parallel with the conveyor unit U.

The connection angle between the miner M and the conveyor unit U may be altered by extending the displaceable guide element 122 of one of the actuators 116 or 118 and retracting the displaceable guide element of the other actuator the same amount. Thus, for example, in order to turn right or toward the top of drawing FIG. 5*a*, the displaceable guide element 122 of the second actuator 118 is extended up to three-quarters of one inch (i.e., the full stroke of the cylinder) while the displaceable guide element 122 of the actuator 116 is retracted three-quarters of an inch. Each actuator 116, 118 comprises a hydraulic cylinder with a 1.5 inch stroke and a 10-inch bore working at up to 3,500 psi. Thus, each actuator 116, 118 generates up to 137 tons of force. The actuators 116, 188 are capable of smoothly and easily changing the connection angle between the miner M and the conveyor unit U.

The change in connection angle is allowed by the slight clearance provided between the first clevis 104 and the first mounting bracket 110, the second clevis 106 and the second mounting bracket 112 and the third clevis 108 and the third mounting bracket 114. In the illustrated embodiment the first and second actuators 116, 118 are capable of changing the connection angle between the miner M and the conveyor unit U up to 2.5 degrees either side of parallel P (see FIG. 6). This allows the operator to maintain the mining apparatus 10 in the desired spatial orientation as it is advanced through the seam while maintaining the proper size pillar between mine openings and also preventing any breakthrough into an adjacent opening and avoiding a potential roof fall resulting therefrom. This is a significant operating advantage since such a roof fall could potentially trap the miner underground possibly preventing recovery of the miner but at the very least interrupting coal production during any recovery operation.

Figure 5A:
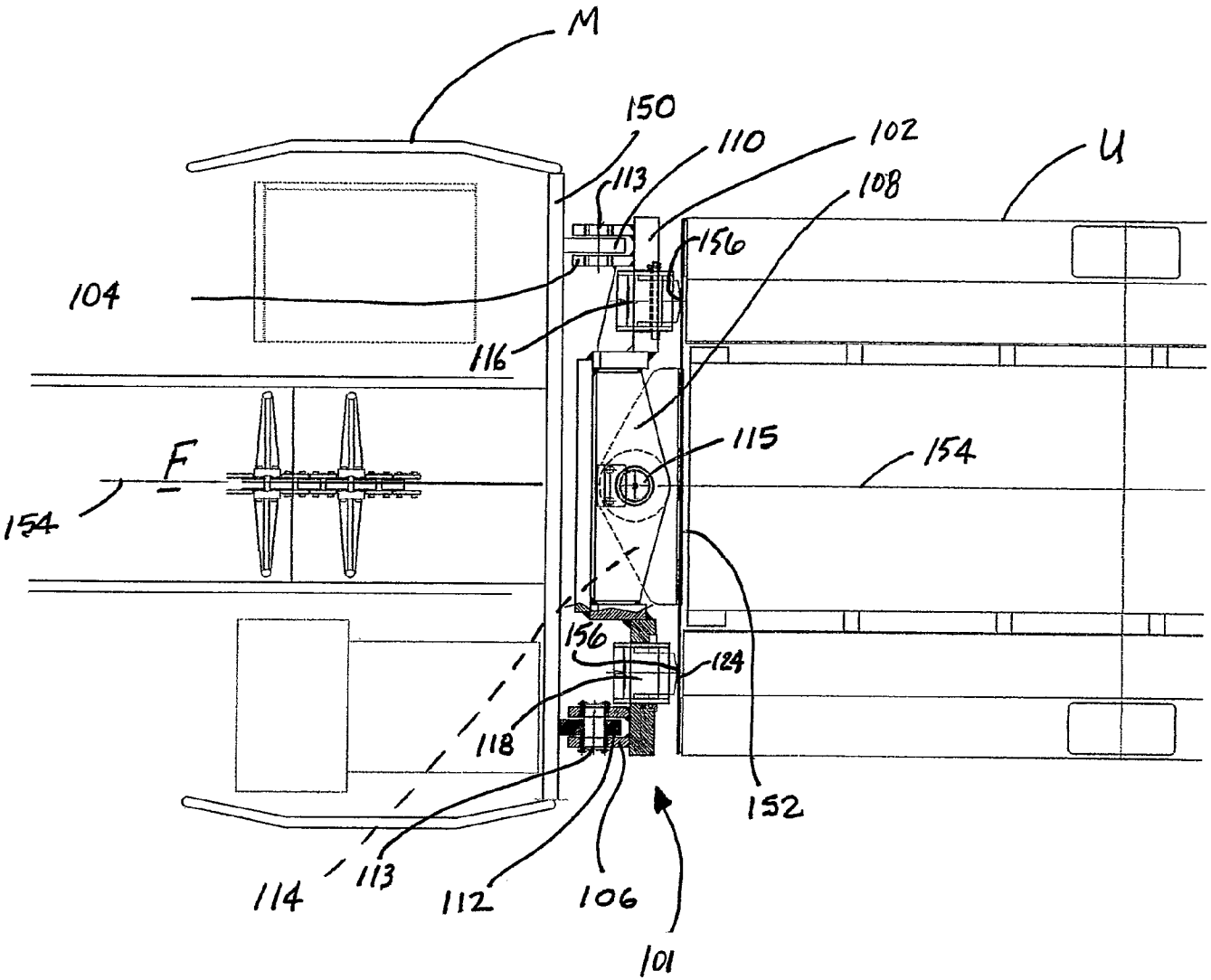
FIGS. 5*a*-5*d* are schematical top plan views of four different embodiments of the present invention illustrating the positioning of the steering unit between the miner and conveyor unit and the locating of the actuators on the steering unit, on the miner or on the conveyor unit.

A directional change to the left or downward in drawing FIG. 5*a* is possible by taking the opposite action. Thus, the displaceable guide element 122 of the actuator 116 may be extended while the guide element of the actuator 118 may be retracted the same amount to force the miner M to deviate up to 2.5 degrees to the left of parallel.

The necessary corrections to maintain the proper directional heading for the miner M are made by the controller 126. More specifically, controller 126 receives actual positioning and heading information from the sensor 125 provided on the miner M. The controller 126 then compares that actual positioning and heading information to a predetermined desired position and heading necessary to provide the desired pillar between adjacent mine openings. Following comparison the controller 126 sends control signals through the control lines 130, 132 to the two actuators 116, 118 to make any necessary heading adjustments. The process is a continuous one and allows the mining apparatus 10 to efficiently and effectively mine deep behind the face F along an intended path.

The mineral seam sensor 134 simultaneously functions to continuously detect the top and bottom of the seam being mined. This data stream is sent to the controller 126 through the control line 136. The controller 126 responds to this data by controlling the operation of the cutter drum D on the end of the boom of the miner M. Thus, the drum D is raised and lowered as necessary to cut the roof and floor at appropriate levels so that clean mineral is won without excessive waste material and the desired roof conditions are also maintained.

The miner M is therefore capable of following the seam whether the bottom of the seam is level or is inclined up or down. Advantageously, the clevis and pivot pin connections between the miner M and the various conveyor units U provides the necessary clearance or play to allow the miner and conveyor units to follow floor undulations and/or inclinations. Additionally, the crowns 124 at the ends of the displaceable guide elements 122 are sufficiently radiused to allow the miner M to follow inclinations and not force or send the miner M off the desired course.

Figure 5B:
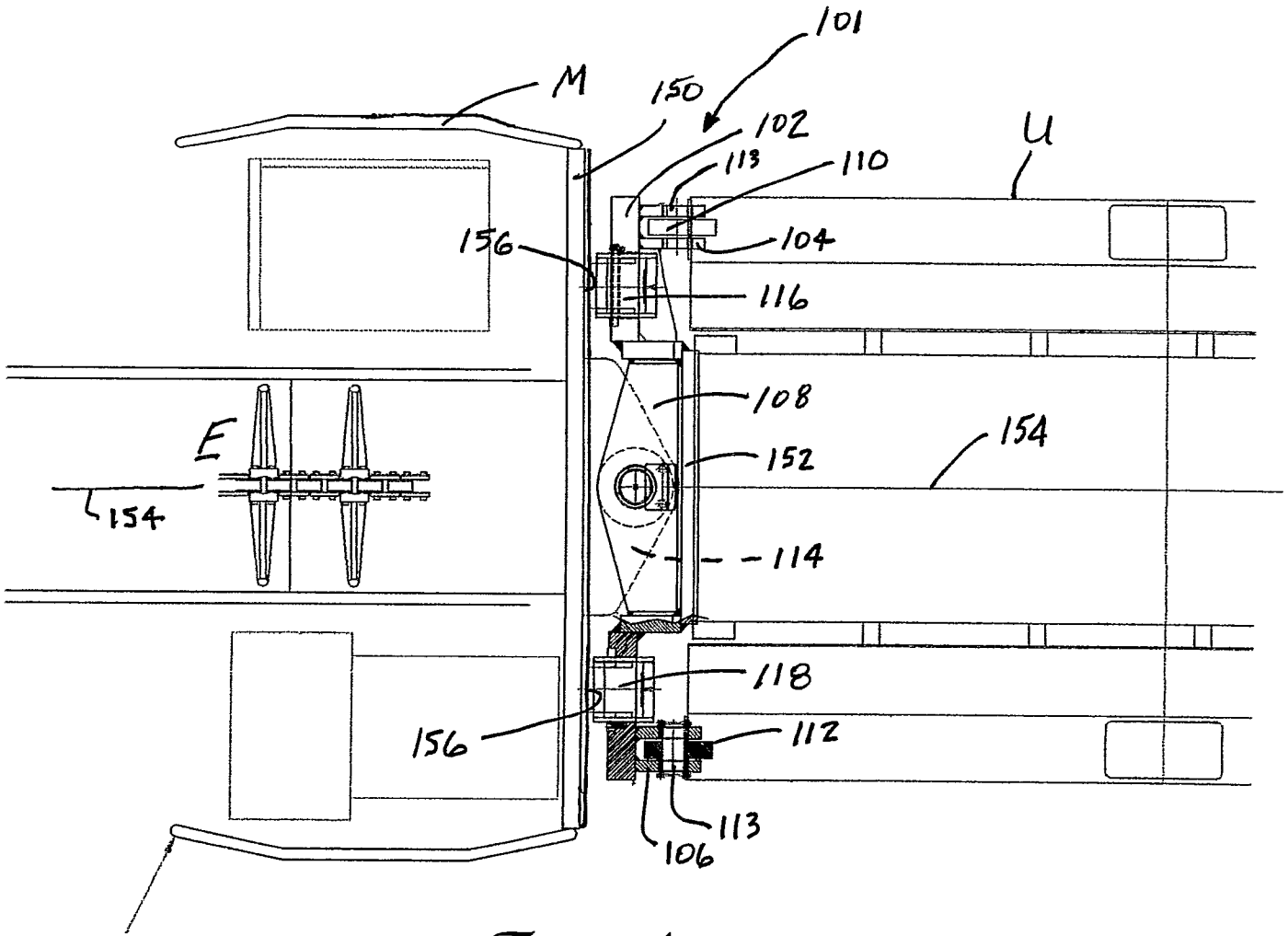
Figure 5C:
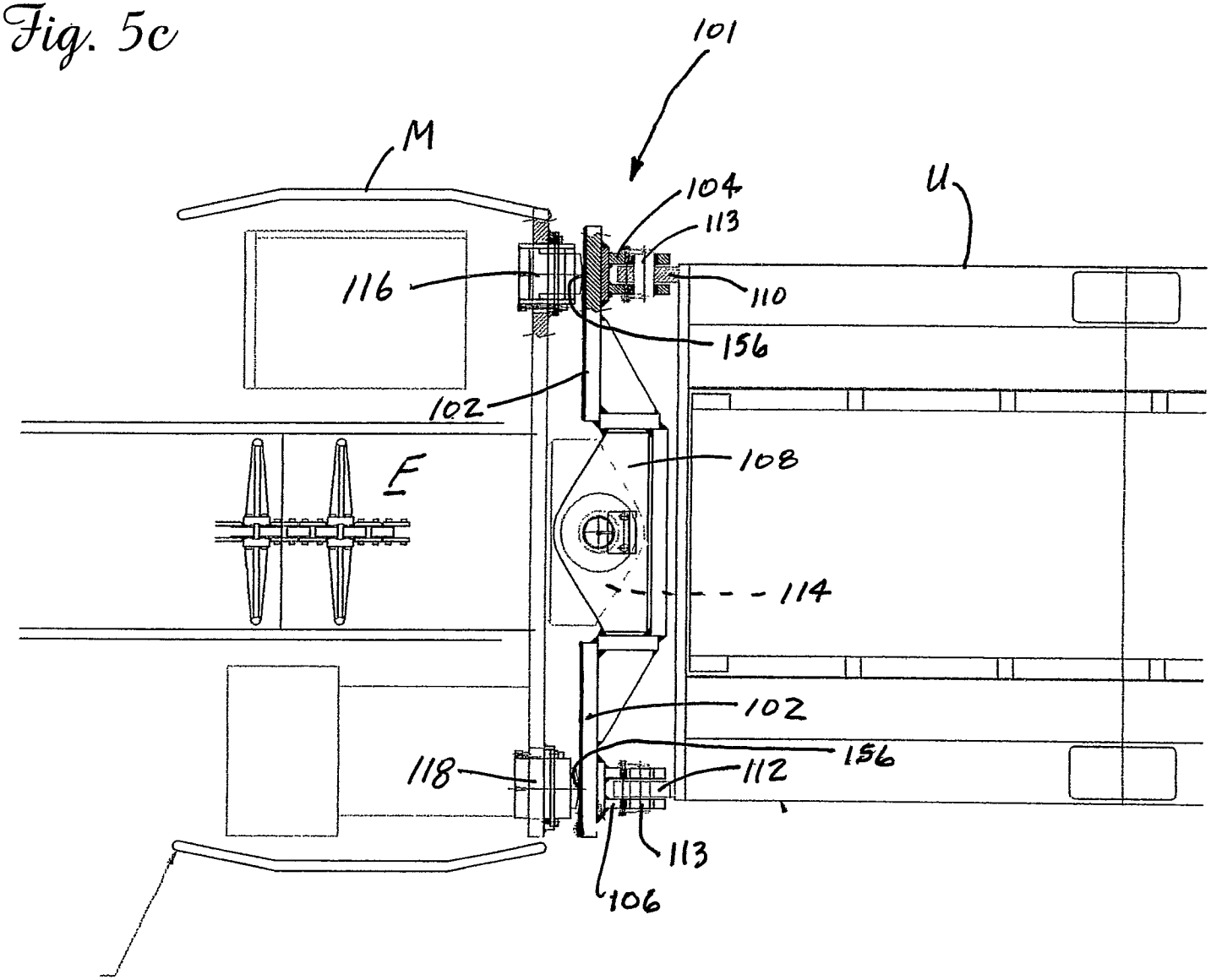
Figure 5D:
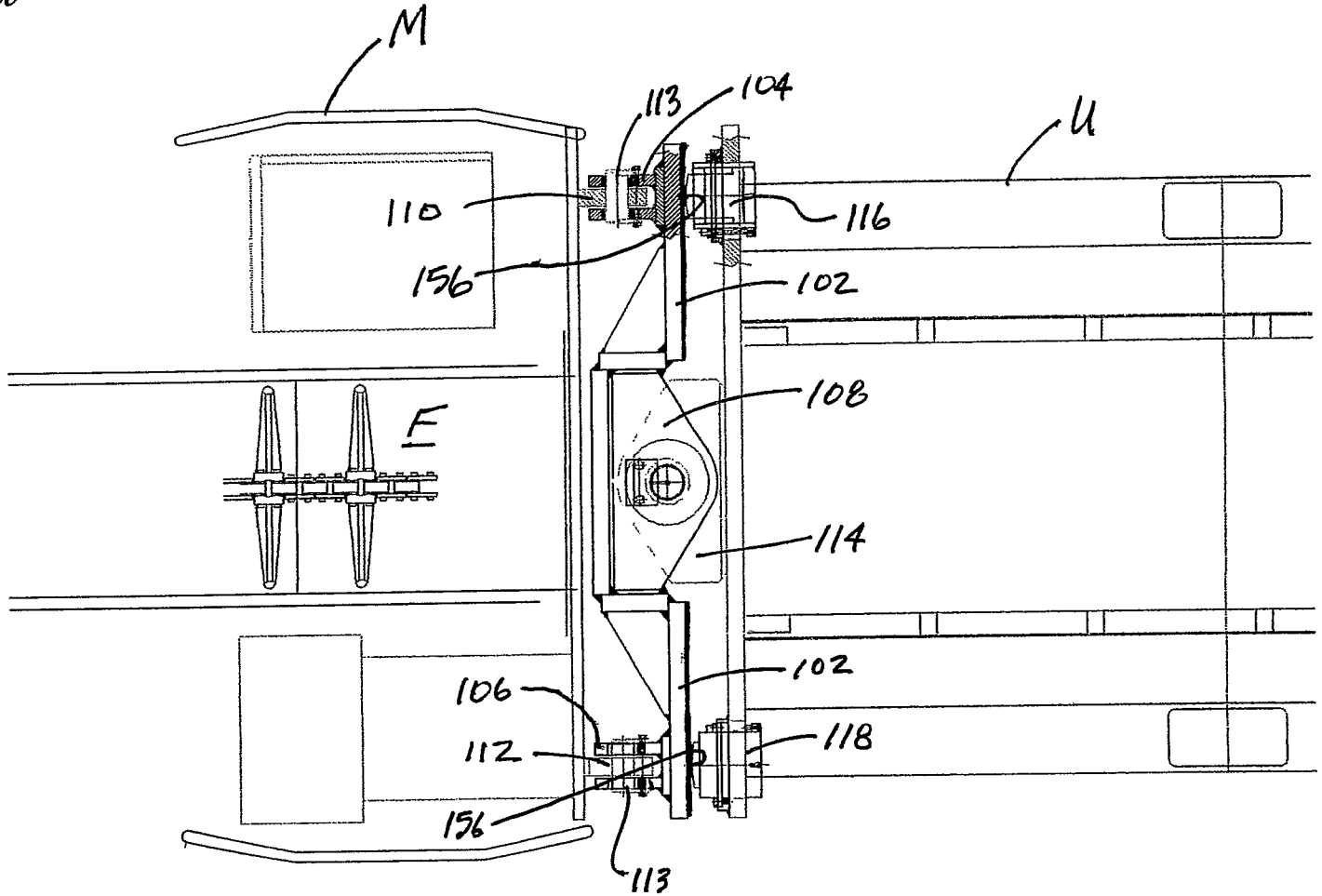
Figure 6:
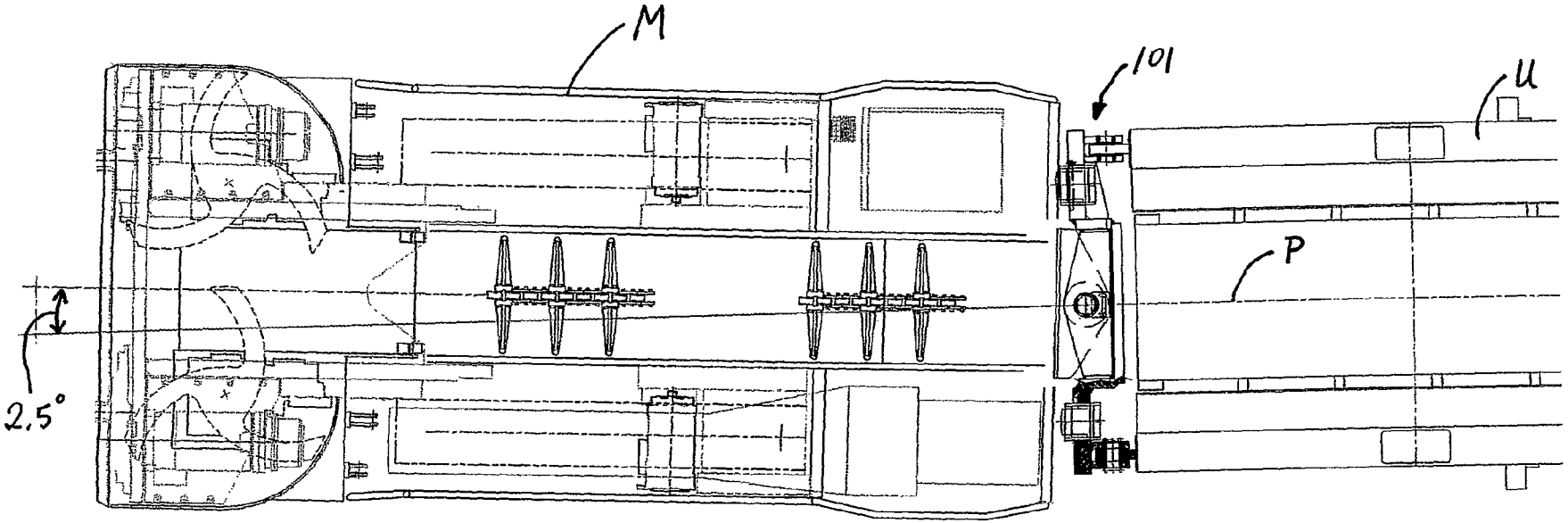
FIG. 6 is a schematical top plan view illustrating how the connection angle between the miner and the conveyor unit may be altered from parallel in order to provide a directional heading change for the miner.

The embodiments illustrated in FIGS. 5*b*, 5*c* and 5*d* operate in a similar manner but there are subtle differences in the assembly of the components. In the FIG. 5*b* embodiment, the steering unit 101 is reversed relative to the miner M and conveyor unit U. Thus, the first and second devises 104, 106 engage mounting brackets 110, 112 connected to the frame or bumper 152 of the conveyor unit U. The third clevis 108 is connected to the third mounting bracket 114 secured to the frame or bumper 150 of the miner M.

Another distinction is the fact that the crowns 124 of the actuators 116, 118 engage bearing surfaces 156 on the bumper 150 of the miner M. The guidance control apparatus 100 and the actuators 116, 118 still, however, function in the same manner to control the directional heading of the miner M as it is advanced into the mineral seam in order to maintain the desired width of the pillar between mine openings.

FIG. 5*c* illustrates yet another embodiment. In this embodiment the first and second devises 104, 106 of the steering unit 101 are connected to mounting brackets 110, 112 carried on the frame or bumper 152 of the conveyor unit U. The third clevis 108 of the steering unit 101 is connected to the mounting bracket 114 carried on the frame or bumper 150 of the miner M. An additional distinction is the fact that the first and second actuators 116, 118 are mounted on the frame or bumper 150 of the miner M. The crown 124 of each actuator engages a bearing surface 156 provided adjacent opposite lateral margins of the frame 102 of the steering unit 101.

While the structure of this embodiment differs from the previous two embodiments, the operating principles are the same. More specifically, the controller 126 operates in response to data sent from the positioning sensor 125 and extends and retracts the displaceable guide elements 122 of the actuators 116, 118 as necessary to control the course of the miner M and provide the desired width of pillar between mine openings. Similarly, the controller 126 operates in response to data received from the mineral seam sensor 134 to control the drum D in order to follow the seam and win clean mineral while maintaining proper roof conditions. As in all embodiments, the clevis connections and the pivot pins function to allow the necessary clearance to allow course adjustments and the ability to follow changes in inclination of the seam floor. Advantageously, the radiused crowns 124 of the actuators 116, 118 insure that proper and consistent guidance control is provided at all times regardless of the inclination of the floor (i.e., whether or not the miner is proceeding upwardly, downwardly or in a level orientation).

Yet another embodiment is illustrated in FIG. 5*d*. In this embodiment the first and second devises 104, 106 of the steering unit 101 are connected to the mounting bracket 110, 112 carried on the bumper 150 of the miner M. The third clevis 108 is connected to the mounting bracket 114 secured to the bumper or frame 152 of the conveyor unit U. The first and second actuators 116, 118 are mounted to the bumper or frame 152 of the conveyor unit U. The crowns 124 on the displaceable guide elements 122 of the actuators 116, 118 engage bearing surfaces 156 on the frame 102 adjacent each lateral margin of the steering unit 101. Again, despite the differences in component assembly, the system operates in the same manner as described above to guide the miner M along the best course to provide efficient and effective mining of the mineral seam.

In summary, numerous benefits result from employing the concepts of the present invention. The mining apparatus 10 incorporates a novel navigation control apparatus or system 100 that guides the miner M with the necessary precision to allow safe and effective mining deep beyond the face of a mineral seam. Advantageously, this deep mining allows greater resource recovery while maintaining the necessary pillar between the mine openings to support the overburden and prevent subsidence. Thus, environmental damage of the mining activity is minimized.

It should also be appreciated that the mining apparatus 10 is guided by a pair of actuators 116, 118 that act upon bearing surfaces 156 that are a part of the mining apparatus. The actuators 116, 118 do not engage or contact the roof, floor or walls/pillars of the mine opening to steer the mining apparatus 10. Thus, no ruts are gouged in the floor and no material is sloughed off of the pillars or roof. Consequently, the roof and pillars are not inadvertently weakened by the steering activity. Further, by avoiding floor ruts and the sloughing of the walls and roof the mine opening is maintained clear for operation of the mining apparatus.

The possibility of breaking through a pillar into an adjacent mine opening is also substantially eliminated. This significantly reduces the prospects of a roof fall that could potentially trap the expensive mining equipment underground. While recovery operations in such a situation may be successful, production losses due to miner down time have an extremely detrimental effect on the bottom line of the mining operation. Accordingly, avoidance of the problem represents a significant benefit well understood by those skilled in the art.

The foregoing description of the preferred embodiments of this invention has been presented for purposes of illustration and description. It is not intended to be exhaustive or to limit the invention to the precise form disclosed. Obvious modifications or variations are possible in light of the above teachings. For example, while the steering unit is illustrated as being connected between the miner and an adjacent conveyor unit, it could also be positioned between two adjacent conveyor units. Further, the steering unit could be eliminated and the actuators could be mounted directly to one unit while the crowns of the actuators engage cooperating bearing surfaces on an adjacent unit.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A mining apparatus, comprising:

a miner;

a conveyor unit;

a steering unit connecting said miner and said conveyor unit;

a positioning sensor;

a controller responsive to said positioning sensor;

a first actuator carried on and connected to only one of said miner, said conveyor unit and said steering unit, said first actuator positioned to a first side of a midline of said miner; and a second actuator carried on and connected to only one of said miner, said conveyor unit and said steering unit, said second actuator positioned to a second, opposite side of said midline of said miner;

wherein said first actuator includes a first displaceable guide element and said second actuator includes a second displaceable guide element, said first and second displaceable guide elements being extended approximately one half the length of their stroke when said miner is aligned with said conveyor unit;

whereby responsive to said controller said first and second actuators adjust a connection angle between said miner and said conveyor unit either side of parallel to determine a directional heading for said miner by one of said first or said second displaceable guide elements extending and the other of said first or said second displaceable guide elements retracting.

2. The mining apparatus of claim 1, wherein said first displaceable guide element includes a first end having a first convex crown and said second displaceable guide element includes a second end having a second convex crown.

3. The mining apparatus of claim 2, wherein said first and second convex crowns have a radius of curvature of about sixteen inches.

4. The mining apparatus of claim 3, wherein said first actuator is a first hydraulic cylinder and said second actuator is a second hydraulic cylinder.

5. The mining apparatus of claim 4, wherein each of said first and said second cylinders have a bore of about 10.0 inches, a stroke of about 1.5 inches and run at up to about 3,500 psi.

6. The mining apparatus of claim 2, wherein said first and second actuators are carried on said steering unit and said first and second ends respectively engage first and second cooperating bearing surfaces on said miner.

7. The mining apparatus of claim 2, wherein said first and second actuators are carried on said steering unit and said first and second ends respectively engage first and second cooperating bearing surfaces on said conveyor unit.

8. The mining apparatus of claim 2, wherein said first and second actuators are carried on said miner and said first and second ends respectively engage first and second cooperating bearing surfaces on said steering unit.

9. The mining apparatus of claim 2, wherein said first and second actuators are carried on said conveyor unit and said first and second ends respectively engage first and second cooperating bearing surfaces on said steering unit.

10. The mining apparatus of claim 1, wherein said steering unit is connected by a first pivot pin to said miner and by a second pivot pin to said conveyor unit.

11. The mining apparatus of claim 10, wherein said first pivot pin extends along a first plane and said second pivot pin extends along a second plane, said first and second planes being substantially perpendicular to one another.

12. The mining apparatus of claim 11, wherein said first plane is horizontal and said second plane is vertical.

13. The mining apparatus of claim 11, wherein said first plane is vertical and said second plane is horizontal.

14. The mining apparatus of claim 1, further including a mineral seam sensor for locating a top and a bottom of the mineral seam being mined.

15. The mining apparatus of claim 14, wherein said mineral seam sensor is a gamma sensor.

16. The mining apparatus of claim 1, wherein spacing between said miner, said steering unit, and said conveyor unit along said midline of said miner remains substantially unchanged during adjustment of said connection angle.

17. A mining apparatus, comprising:

a miner;

a conveyor unit pivotally connected to said miner at a midline of said miner; and a steering mechanism including a first displaceable steering element located at a first side of said miner midline and a second displaceable steering element located at a second side of said miner midline, said steering mechanism being carried by one of said miner and said conveyor unit, and said first and said second displaceable steering elements engaging, but not connecting to, the other of said miner and said conveyor unit whereby a connection angle between said miner and said conveyor unit is adjusted to determine a directional heading for movement of said miner by one of said first or said second displaceable steering elements extending and the other of said first or said second displaceable steering elements retracting.

18. The mining apparatus of claim 17, further including a positioning sensor carried on said miner and a controller responsive to said positioning sensor.

19. The mining apparatus of claim 18, further including a mineral seam sensor for locating a top and a bottom of the mineral seam being mined.

20. The mining apparatus of claim 19, wherein said mineral seam sensor is a gamma sensor.

21. A method of guiding a mining apparatus including a miner and a conveyor unit through a mineral seam, comprising:

determining an actual position and heading for said miner;

comparing said actual position and heading to a desired position and heading for said miner;

adjusting a steering mechanism, said steering mechanism including a first displaceable steering element located at a first side of a midline of said miner and a second displaceable steering element located at a second side of said miner midline, engaged between said miner and said conveyor unit by one of said first or said second displaceable steering elements extending against a bearing surface and the other of said first or said second displaceable steering elements retracting to bring said miner to said desired directional heading, wherein said first and second displaceable steering elements are not connected to the bearing surface; and advancing said miner along said desired directional heading.

* * * * *